US006328005B1

(12) United States Patent
Klausnitzer et al.

(10) Patent No.: US 6,328,005 B1
(45) Date of Patent: Dec. 11, 2001

(54) ELECTROMAGNETIC ASSEMBLY ACTUATOR FOR OPERATING GAS EXCHANGE VALVES OF A COMBUSTION ENGINE AND METHOD OF MAKING SAME

(75) Inventors: Herbert Klausnitzer, Inning; Albert Hoerl, Taufkirchen; Clemens Luchner, Baldham; Wolfgang Hundt, Munich, all of (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 09/657,657

(22) Filed: Sep. 11, 2000

(30) Foreign Application Priority Data

Sep. 11, 1999 (DE) ..... 199 43 620

(51) Int. Cl.[7] ..... F01L 9/04

(52) U.S. Cl. ..... 123/90.11; 251/129.15; 251/129.16

(58) Field of Search ..... 123/90.11; 251/129.01, 251/129.15, 129.16

(56) References Cited

U.S. PATENT DOCUMENTS

| | | | | |
|---|---|---|---|---|
| 3,853,102 | | 12/1974 | Myers et al. | 123/90.49 |
| 4,779,582 | | 10/1988 | Lequesne et al. | 123/90.11 |
| 5,903,204 | | 5/1999 | Schmitz | 335/227 |
| 5,941,201 | * | 8/1999 | Shimizu et al. | 123/90.11 |

FOREIGN PATENT DOCUMENTS

| | | |
|---|---|---|
| 19531365 | 2/1997 | (DE) . |
| 198 38 101 | 8/1998 | (DE) . |
| 19756095 | 6/1999 | (DE) . |
| 19807181 | 8/1999 | (DE) . |

* cited by examiner

*Primary Examiner*—Wellun Lo
(74) *Attorney, Agent, or Firm*—Crowell & Moring LLP

(57) ABSTRACT

For an arrangement with an electromagnetic actuator for actuation of a gas exchange valve of a combustion engine, for gas exchange valves that are basically aligned with a row of cylinders in the combustion engine, actuators are arranged in a joint, strip-shaped housing, which is split into two parts by notched separation for assembling the actuators.

17 Claims, 3 Drawing Sheets

ELECTROMAGNETIC ASSEMBLY ACTUATOR FOR OPERATING GAS EXCHANGE VALVES OF A COMBUSTION ENGINE AND METHOD OF MAKING SAME

BACKGROUND AND SUMMARY OF THE INVENTION

This application claims the priority of German patent document 199 43620.7, filed Sep. 11, 1999, the disclosure of which is expressly incorporated by reference herein.

The invention relates to an arrangement with an electromagnetic actuator for operating a gas exchange valve of a combustion engine, comprising solenoids on both sides of an oscillating driveable armature in a multi-component carrying device for the arrangement on the engine side, which is formed as a frame-like housing connected in one piece via crossbars with spaced support carriers, and the support carriers are divided across the stroke direction of the armature between the crossbars and are secured in relation to each other via clamping devices that are braced against each other for the arrangement on the an engine side of an actuator.

This type of arrangement is the object of German patent application 198 38 101, whereby an arrangement was proposed for driving an individual gas exchange valve.

A non-generic arrangement for driving an intake and exhaust valve of a cylinder of a combustion engine is known from U.S. Pat. No. 3,853,102, whereby the individual actuators for the above-mentioned gas exchange valves are arranged on a joint carrying device that can be attached to the cylinder head.

Further, a non-generic arrangement for operating two similar gas exchange valves is known from U.S. Pat. No. 4,779,582, whereby in a two-part housing receiving both the closing spring and the opening spring, a joint solenoid is used to guide the armature firmly attached to the valve shafts.

An object of the invention is to further extend the generic arrangement for the operation of a plurality of gas exchange valves, whereby this objective is achieved with a simplified construction by utilizing a notched separation.

This object is achieved according to preferred embodiments of the invention, wherein actuators for the basically aligned gas exchange valves arranged at a row of cylinders of the combustion engine are arranged in a joint, strip-shaped housing, and the housing is split in two by a notched separation of the support as carriers approximately at the height of the suspended armatures, whereby for a basically simultaneous separation, the support carriers across the stroke direction of the armatures, have approximately midlevel openings that mate with adjusting bolts which can basically be arranged in parallel with the stroke direction of the armatures.

In an advantageous way, the invention provides a housing that can receive a plurality of actuators for gas exchange valves for a plurality of cylinders, whose manufacture is cost efficient, and whose total assembly, in a further advantageous way, costs less than a plurality of individual housings with actuators for driving the valves. With the arrangement according to the invention, the dimensions indicated for the cylinder head would allow large surface solenoids to be used.

Other objects, advantages and novel features of the present invention will become apparent from the following detailed description of the invention when considered in conjunction with the accompanying drawings.

DETAILED DESCRIPTION OF THE DRAWINGS

Figure 1:
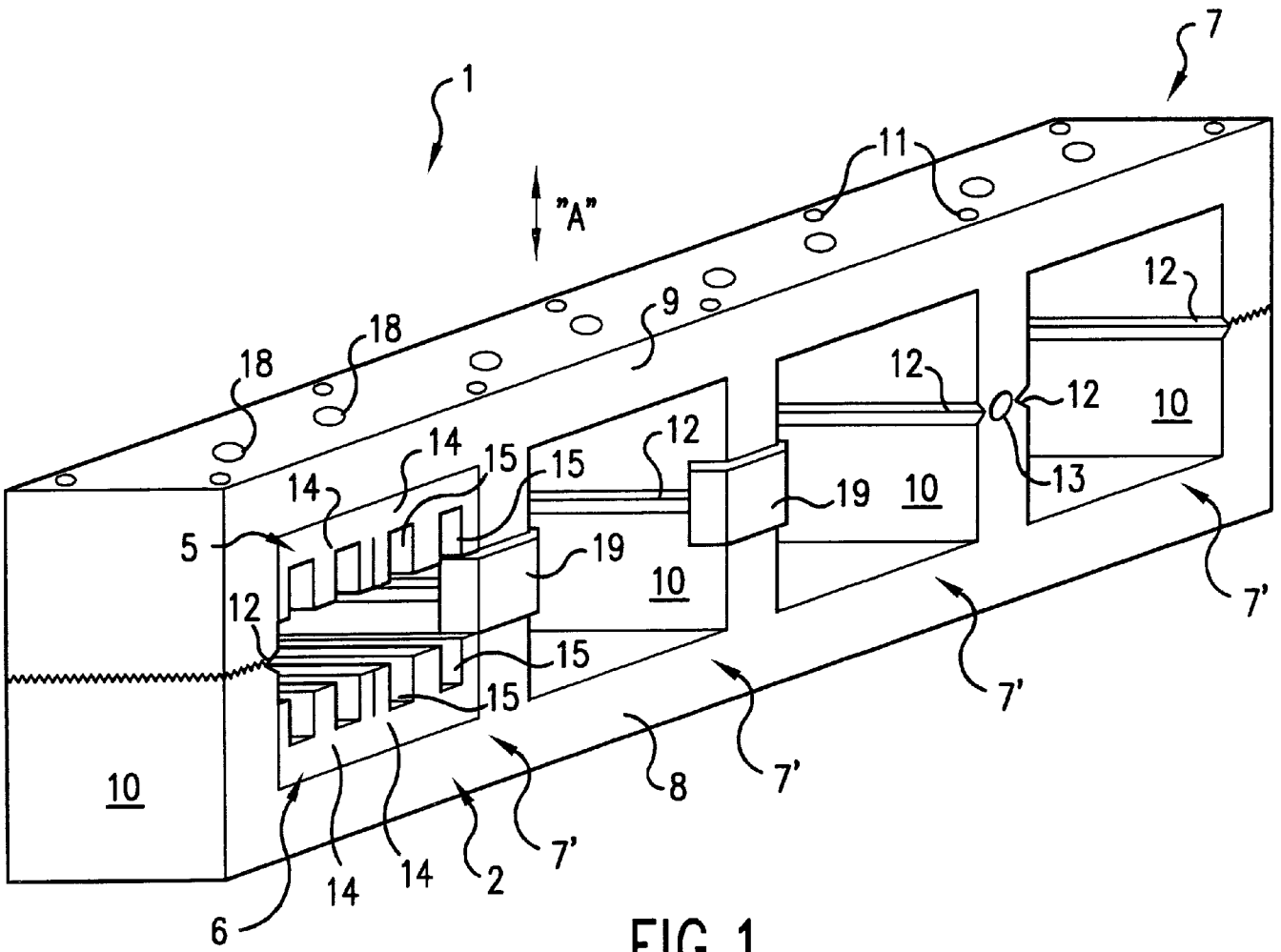
FIG. 1 is a perspective view showing a housing for electromagnetic actuators for actuating a plurality of engine valves and a plurality of cylinders arranged in a row, constructed according to a preferred embodiment of the invention.
Figure 2:
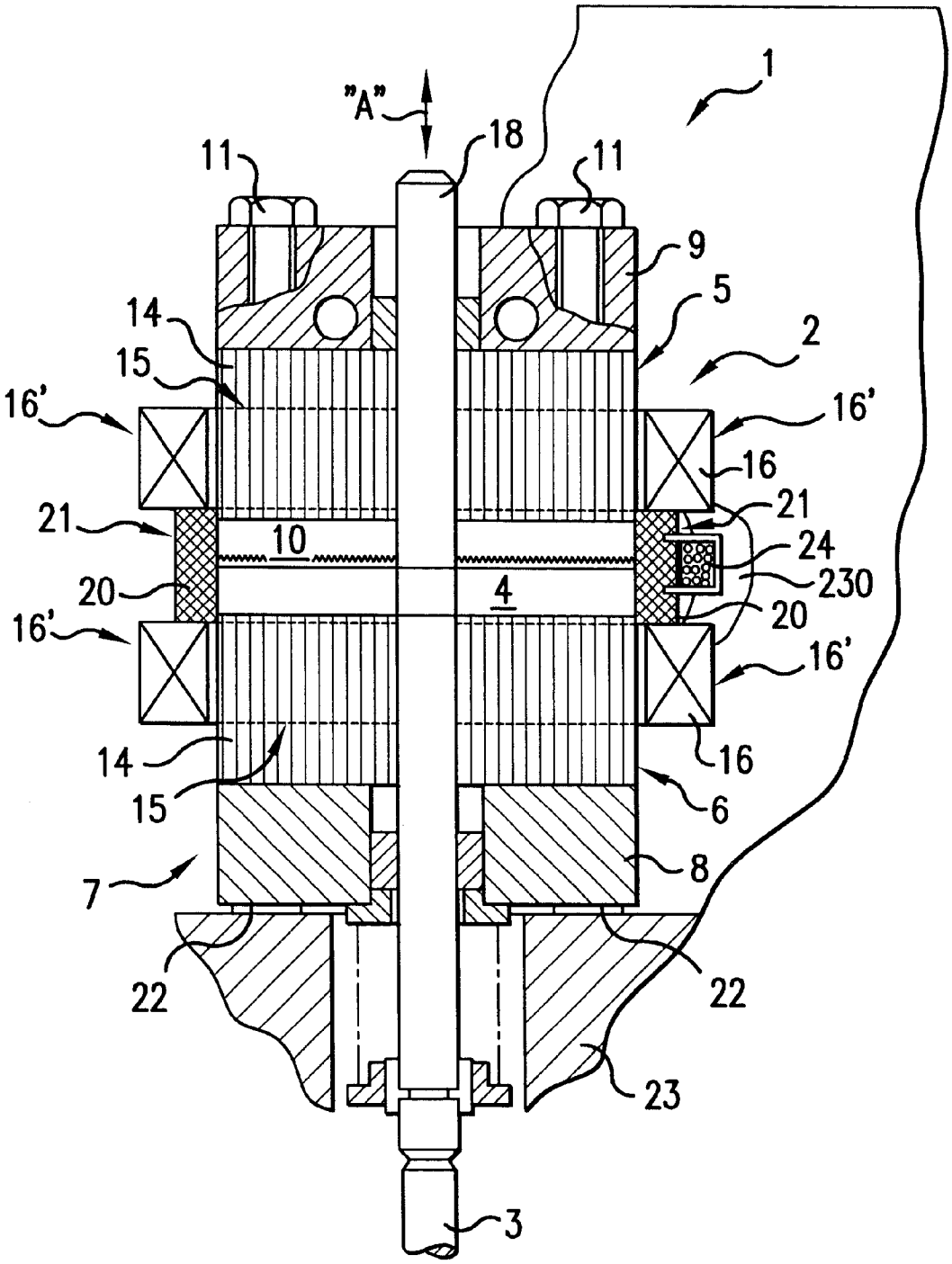
FIG. 2 is a cross-sectional view of the housing of FIG. 1, showing an actuator for one of the engine valves.

FIG. 2 shows an arrangement 1 with an electromagnetic actuator 2 for operating a gas exchange valve 3 of a combustion engine, which comprises solenoids 5 and 6 on both sides of a travel oscillating armature 4. A plurality of such actuators 2 are supported in a multi-component carrying device used for an engine-side arrangement, which carrying device is formed as a frame-like housing 7 with spaced support carriers 10, connected in one piece via crossbars 8 and 9. The support carriers 10 are divided across a stroke direction of the armature 4 between housing crossbars 8 and 9 and are secured in relation to each other via clamping adjusting bolts 11 that are braced against each other for an arrangement on the engine side of the actuator 2.

For further construction of this arrangement 1 for the purpose of operating a plurality of gas exchange valves at a plurality of cylinders of the combustion engine (only cylinder head 23 being shown in FIG. 2) with the further objective of a simplified construction of the arrangement 1 by a notched separation, the invention provides that actuators 2 for the basically aligned gas exchange valves 3 in front of a row of cylinders of the combustion engine are arranged in the joint strip-shaped housing 7. Further, the housing 7 is split into two parts by a notched separation of the support carriers 10 approximately at a height of the suspended armatures 4, whereby, for a basically simultaneous separation, the support carriers 10, which are divided across the stroke direction "A" of the armature at the notch indentations 12, have approximately midlevel openings 13 which mate with and cross openings for the adjusting bolts 11, which adjusting bolts 11 and openings therefor are arranged to extend in parallel to the stroke direction of the armatures 4.

To ensure a reliable separation, the strip-shaped housing 7 is cast from a silicon, particulate or fibrous light metal alloy. Further, the solenoids 5 and 6 have coil cores 14 made of core sheets connected with the support carriers 10 and/or sections of the crossbars 8 and 9 respectively for the purpose of heat dissipation in plane arrays. The coil cores 14 are cast into the housing 7 in an untreated state or are installed subsequently in a machined state to be installed by friction or form.

A simpler configuration of the housing 7 is further achieved, in that a plurality of coil cores 14 corresponding to a plurality of gas exchange valves 3 of a cylinder—an intake and an exhaust valve or, respectively, two similar gas exchange valves for intake and exhaust, are arranged in housing sections 7A'–7D' between two adjoining support carriers 10.

Figure 3:
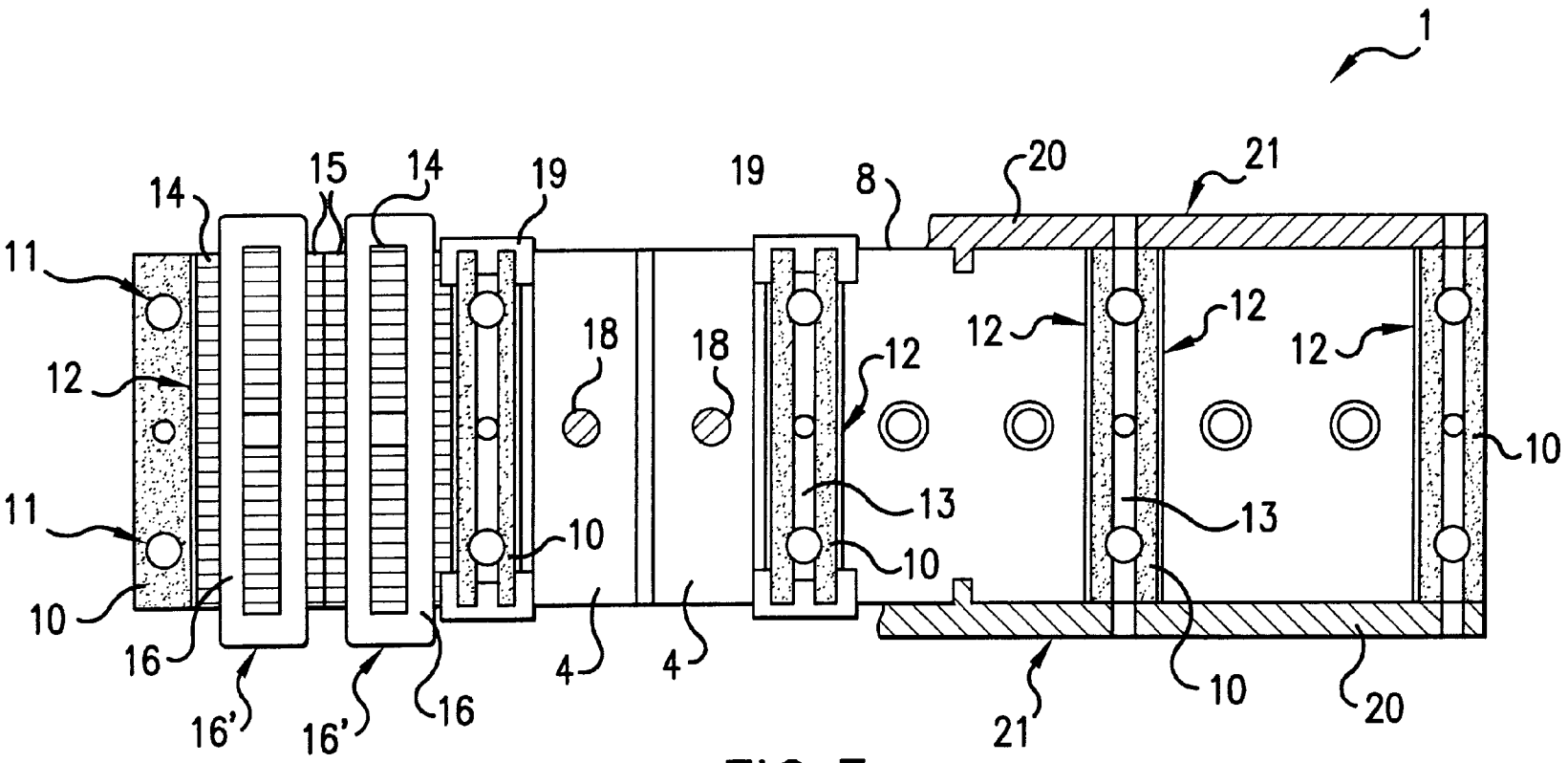
FIG. 3 is a top view of a crossbar of the housing of FIG. 1 on a cylinder head side of the housing with various functional parts of the housing and actuators.

FIG. 3 schematically depicts respective different features of the assembly in the differently designated sections 7A'–7D'. It is to be understood that each section would have all of the features depicted. The coil cores 14 have open, channel-type recesses 15 on both ends for receiving solenoids 16 running in sections around the coil cores 14, like the ones that can be seen in housing section 7A' in FIG. 3. This design of the solenoids 16 is used on the one hand as a simple connection for the power and control circuits (not shown) and for additional cooling of the solenoids 16, on the other.

Further, it can be seen from another housing section 7B' in FIG. 3 that a plurality of rams or pushrods 18 that are driven by the armatures 4 supported at crossbars 8 and 9 according to FIG. 2, correspondingly fit the solenoids 16 basically in a right-angled shape, and that the armatures 4 are secured against rotation for proper operation on the front end and/or longitudinally by slide guide elements 19, 20 that can be disposed on the support carriers 10. For example, U-shaped slide guide elements 19 are disposed on end faces of the support carriers 10 and are secured in openings 13, as can be seen in FIG. 3 by interengaging detent parts.

Further, it can be seen in FIGS. 2 and 3, that a cover strip 21 of the diametrically arranged solenoid 16' has been configured as a further slide guide element 20, which, respectively, has been secured to the housing 7 with the interlocking fastening protrusion in the openings 13 (see housing section 7C' and 7D' of FIG. 3). Each of these cover strips 21 can also be used to secure the solenoids 16 and further to carry a harness module 24.

As can be seen in closer detail in FIG. 2, the strip-shaped housing 7 beyond the projections 22 arranged on the crossbar 8 on the cylinder head side has relatively few contact surfaces in heat-dissipating connection with cooled bearing surfaces on the cylinder head 23, whereby the housing 7, which is in two parts for assembly purposes, can be treated as one piece by means of separate screws (not shown), and is fastened by means of the through extending adjusting bolts 11 to the cylinder head 23.

Finally, a power and control circuit comprising a harness module 24 for the actuators 2 is disposed on the strip-shaped housing 7, whereby the harness module 24 on one of the cover strips 21 is preferably fed outwardly through a wall opening 230 in the cylinder head 23 (FIG. 2).

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Device with electromagnetic actuators for actuation of gas exchange valves of a combustion engine, comprising:

actuators which each include solenoids on both sides of a travel oscillating driveable armature in a multi-component support carrier unit for an arrangement on an engine side, said support carrier unit being formed as a frame-like strip-shaped housing with support carriers connected in one piece via crossbars, whereby the support carriers are divided across a stroke direction of the armature between the crossbars and are secured in relation to each other via clamping devices that are braced against each other for an arrangement on an engine side of the actuator, wherein the actuators for the basically aligned gas exchange valves are arranged adjacent a row of cylinders of the combustion engine in the strip-shaped housing, and wherein the housing is split into two parts by means of a notched separation of the support carriers approximately at the level of a suspended armature, whereby for a basically simultaneous separation of the support carriers, openings are arranged across the stroke direction of the armature (arrow "A") between notched indentations at the notched separation, which mate with adjusting bolts, which is arranged basically in parallel with a stroke direction of the armature (arrow "A").

2. Device according to claim 1, wherein the strip-shaped housing is cast from a particulate light metal alloy, wherein core-sheet constructed coil cores of the solenoids are respectively disposed in plane arrays with the support carriers and/or with sections of the crossbars, wherein the coil cores are one of (i) cast into the housing in an untreated state and (ii) inserted subsequently in a treated state and joined to the housing by form and/or friction fit connection.

3. Device according to claim 2, wherein a plurality of the coil cores are disposed in a housing section between two adjoining support carriers corresponding to a plurality of gas exchange valves of a cylinder, whereby the coil cores have open, channel-type recesses on both ends for receiving solenoids running in sections outside the coil cores.

4. Device according to claim 3, wherein a plurality of pushrods driven by the lifting motions of the armature correspondingly fit the solenoids basically in a right-angled shape in respective housing sections, and wherein the armatures are secured against rotation on the front end and/or lingitudinally bey means of slide guide elements arranged on the support carriers.

5. Device according to claim 1, wherein the strip-shaped housing beyond projections disposed on the crossbar on the cylinder head side has relatively few contact surfaces in heat-dissipating connection with cooled bearing surfaces on the cylinder head, and wherein the two-part housing is mounted by means of adjusting bolts which are attached on the cylinder head.

6. Device according to claim 2, wherein the strip-shaped housing beyond projections disposed on the crossbar on the cylinder head side has relatively few contact surfaces in heat-dissipating connection with cooled bearing surfaces on the cylinder head, and wherein the two-part housing is mounted by means of adjusting bolts which are attached on the cylinder head.

7. Device according to claim 3, wherein the strip-shaped housing beyond projections disposed on the crossbar on the cylinder head side has relatively few contact surfaces in heat-dissipating connection with cooled bearing surfaces on the cylinder head, and wherein the two-part housing is mounted by means of adjusting bolts which are attached on the cylinder head.

8. Device according to claim 4, wherein the strip-shaped housing beyond projections disposed on the crossbar on the cylinder head side has relatively few contact surfaces in heat-dissipating connection with cooled bearing surfaces on the cylinder head, and wherein the two-part housing is mounted by means of adjusting bolts which are attached on the cylinder head.

9. Device according to claim 1, wherein a harness module comprising a power and control circuit for the actuators is disposed on the strip-shaped housing, and wherein the harness module is fed outwardly through a wall opening in the cylinder head.

10. Device according to claim 2, wherein a harness module comprising a power and control circuit for the actuators is disposed on the strip-shaped housing, and wherein the harness module is fed outwardly through a wall opening in the cylinder head.

11. Device according to claim 3, wherein a harness module comprising a power and control circuit for the actuators is disposed on the strip-shaped housing, and wherein the harness module is fed outwardly through a wall opening in the cylinder head.

12. Device according to claim 4, wherein a harness module comprising a power and control circuit for the actuators is disposed on the strip-shaped housing, and wherein the harness module is fed outwardly through a wall opening in the cylinder head.

13. Device according to claim 5, wherein a harness module comprising a power and control circuit for the actuators is disposed on the strip-shaped housing, and wherein the harness module is fed outwardly through a wall opening in the cylinder head.

14. An electromagnetic actuator assembly for actuation of gas exchange valves of a combustion engine of the type having a cylinder head covering a plurality of engine cylinders and associated gas exchange valves, said actuator assembly comprising:

a strip-shaped housing formed from a pair of crossbars connected by a plurality of support carriers to form a plurality of adjacent housing sections separated by respective support carriers, one of said crossbars being configured to extend along and be connected with an engine cylinder head, and electromagnetic actuators disposed in the respective housing sections and operable to actuate respective engine gas exchange valves, said actuators each including a moveable armature with solenoids at respective opposition sides of the armature to control movement of the armature in a stroke direction parallel to the support carriers, wherein the housing is formed in two parts with a notched separation of the two parts in the support carriers and with openings in the support carriers extending transversely of the stroke direction between notched indentations at the notched separation, and wherein the two parts of the housing are clamped together by adjusting bolts extending parallel to the stroke direction through the support carriers.

15. An assembly according to claim 14, wherein the housing parts are cast from a particulate light metal alloy.

16. A method of making of an electromagnetic actuator assembly for actuation of gas exchange valves of a combustion engine of the type having a cylinder head covering a plurality of engine cylinders and associated gas exchange valves, said actuator assembly comprising:

a strip-shaped housing formed from a pair of crossbars connected by a plurality of support carriers to form a plurality of adjacent housing sections separated by respective support carriers, one of said crossbars being configured to extend along and be connected with an engine cylinder head, and electromagnetic actuators disposed in the respective housing sections and operable to actuate respective engine gas exchange valves, said actuators each including a moveable armature with solenoids at respective opposition sides of the armature to control movement of the armature in a stroke direction parallel to the support carriers, said method comprising:

forming the housing in two parts with a notched separation of the two parts in the support carriers and with openings in the support carriers extending transversely of the stroke direction between notched indentations at the notched separation, and wherein the two parts of the housing are clamped together by adjusting bolts extending parallel to the stroke direction through the support carriers.

17. A method of making of making an assembly according to claim 16, wherein the housing parts are cast from a particulate light metal alloy.

* * * * *